US009302373B2

(12) United States Patent
Johnson

(10) Patent No.: US 9,302,373 B2
(45) Date of Patent: Apr. 5, 2016

(54) WRENCH WITH PIVOTABLE RATCHETING OPEN END WRENCH HEAD

(71) Applicant: Deron Johnson, Marathon, NY (US)

(72) Inventor: Deron Johnson, Marathon, NY (US)

( * ) Notice: Subject to any disclaimer, the term of this patent is extended or adjusted under 35 U.S.C. 154(b) by 321 days.

(21) Appl. No.: 13/773,681

(22) Filed: Feb. 22, 2013

(65) Prior Publication Data

US 2013/0255060 A1 Oct. 3, 2013

Related U.S. Application Data

(60) Provisional application No. 61/619,069, filed on Apr. 2, 2012.

(51) Int. Cl.

| | |
|---|---|
| ***B25B 13/46*** | (2006.01) |
| ***B25B 13/08*** | (2006.01) |
| ***B25B 23/00*** | (2006.01) |

(52) U.S. Cl.

CPC ..... *B25B 13/46* (2013.01); *B25B 13/08* (2013.01); *B25B 23/0028* (2013.01); *Y10T 29/49826* (2015.01); *Y10T 29/49881* (2015.01); *Y10T 29/49945* (2015.01); *Y10T 29/49947* (2015.01)

(58) Field of Classification Search

CPC .... B25B 13/46; B25B 23/0028; B25B 13/08; Y10T 29/49881; Y10T 29/49826; Y10T 29/49945; Y10T 29/49947

See application file for complete search history.

(56) References Cited

U.S. PATENT DOCUMENTS

| | | | | |
|---|---|---|---|---|
| 1,060,185 | A | 4/1913 | Hitt | |
| 2,376,575 | A | 5/1945 | Cronan | |
| 2,401,128 | A | 5/1946 | Anderson | |
| 2,521,419 | A | 9/1950 | Sellers | |
| 2,551,669 | A | 5/1951 | Hale | |
| 2,851,914 | A | 9/1958 | Zeckzer | |
| 3,161,091 | A | 12/1964 | Searcy | |
| 4,534,245 | A | 8/1985 | Rossmann | |
| 4,926,720 | A | 5/1990 | Srzanna | |
| 5,454,283 | A * | 10/1995 | Stefano | 81/58.2 |
| 6,155,140 | A | 12/2000 | Tsai | |
| 6,543,313 | B2 | 4/2003 | Samudosky | |
| 6,559,613 | B1 | 5/2003 | Elliott et al. | |
| 6,568,300 | B1 | 5/2003 | Steffe | |
| 2006/0137492 | A1 | 6/2006 | Melos | |

* cited by examiner

*Primary Examiner* — John C Hong
(74) *Attorney, Agent, or Firm* — Brown & Michaels, PC

(57) ABSTRACT

A wrench includes a wrench shaft and a wrench head pivotally mounted on the first end of the wrench shaft. The wrench head includes a pair of protrusions with engaging surfaces and a plurality of ratchet teeth arranged radially around a pivot hole. A pawl including a plurality of pawl teeth is mounted in a machined slot in the wrench shaft. A biasing element biases the pawl teeth toward engagement with the ratchet teeth. A reset mechanism is coupled to the pawl. A method of rotating a rotary fastener around a threaded shaft includes rotating a wrench shaft with respect to a wrench head such that the ratchet mechanism ratchets at least one step, where the wrench head is laterally removable from the rotary fastener by way of the slot regardless of the position of the wrench head within the range of motion of the wrench head.

19 Claims, 2 Drawing Sheets

WRENCH WITH PIVOTABLE RATCHETING OPEN END WRENCH HEAD

REFERENCE TO RELATED APPLICATIONS

This application claims one or more inventions which were disclosed in Provisional Application No. 61/619,069, filed Apr. 2, 2012, entitled "WRENCH WITH PIVOTABLE RATCHETING OPEN END WRENCH HEAD". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of wrenches. More particularly, the invention pertains to a wrench with a rotating ratcheting open end.

2. Description of Related Art

Wrenches are commonly used for tightening, loosening, or removing rotary fasteners from threaded shafts. Open end wrench heads are commonly angled at 15° with respect to the wrench shaft so that when the user has only limited space for the rotation of a hexagonal fastener in the range of greater than 30° but less than 60°, by rotating the fastener about 30°, flipping the wrench over, and rotating again about 30°, the user can rotate the hexagonal fastener by the 60° necessary to slide the wrench around the next pair of sides and rotate the hexagonal fastener further.

Closed-end wrenches and socket wrenches commonly include a ratcheting mechanism such that the head of the wrench locks with respect to the wrench shaft when the wrench is turned in one direction but rotates freely in the other direction. This allows the user to turn the rotary fastener as many times as needed in one direction without taking the wrench off the fastener.

There are situations, however, such as in hydraulic lines or certain confined spaces, where a rotary fastener is located such that only an open end wrench may be used and only a limited range of rotation (less than 30°) of the wrench is possible.

There have been a number of attempts to create a wrench with a continuously rotatable ratcheting open end, including U.S. Pat. No. 2,376,575, entitled "Ratchet Wrench" and issued May 22, 1945 to Cronan, U.S. Pat. No. 2,401,128, entitled "Open End Ratchet Wrench" and issued May 28, 1946 to Anderson, U.S. Pat. No. 2,551,669, entitled "Ratchet-Pawl Retaining Structure" and issued May 8, 1951 to Hale, U.S. Pat. No. 2,851,914, entitled "Open End Ratchet Wrench" and issued September 16, 1958 to Zeckzer, and U.S. Patent Application Publication No. 2006/0137492, entitled "Reversible Ratcheting Open-End Wrench" by Melos and published Jun. 29, 2006. In each of these designs, a non-rotating support structure extends to the tip of the open end of the wrench such that once the rotating slot portion of the wrench rotates away from the non-rotating slot portion, the wrench head essentially becomes a closed-end head until the rotating portion rotates the full 360°. Thus, it is only possible to slide the wrench head back off the rotary fastener after each full rotation of the fastener. Each of these designs requires a wider head than a standard open-end head to support the circular rotating portion of the head, which prevents usage of the wrench in certain confined spaces. Each of these designs also requires at least two pawls in order for at least one pawl to be engaged with the ratchet teeth of the wrench head at all times.

The designs of U.S. Pat. No. 2,521,419, entitled "Ratchet-Actuated Open-End Wrench" and issued Sep. 5, 1950 to Sellers and U.S. Pat. No. 6,155,140, entitled "Ratchet Wrench" and issued Dec. 5, 2000 to Tsai use wider openings for the stationary parts of the open end, which provides a range of angles over which the wrench can be slid off the fastener, but again, two pawls and a wider head are required in order for the head to be continuously rotatable.

The above-mentioned patent documents are hereby incorporated by reference herein.

SUMMARY OF THE INVENTION

In some embodiments, a wrench includes a wrench shaft having a first end and a second end opposite the first end and a wrench head pivotally mounted on the first end of the wrench shaft. The wrench head includes a first end including a pair of protrusions and a second end including a plurality of ratchet teeth arranged radially around a pivot hole. Each protrusion has an engaging surface with a slot being formed between the engaging surfaces. A pawl including a plurality of pawl teeth is mounted in a machined slot in the wrench shaft. A biasing element biases the pawl teeth toward engagement with the ratchet teeth. A reset mechanism is coupled to the pawl.

In some embodiments, a method of rotating a rotary fastener around a threaded shaft includes placing a pair of protrusions of a wrench around the rotary fastener. The wrench includes a wrench shaft having a first end and a second end opposite the first end, a wrench head pivotally mounted on the first end of the wrench shaft, a ratcheting mechanism and a reset mechanism. The wrench head includes the protrusions, each protrusion having an engaging surface and a slot being formed between the engaging surfaces. The ratcheting mechanism permits pivoting of the wrench shaft in a first direction with respect to the wrench head but limits pivoting of the wrench shaft in a second direction opposite the first direction. The reset mechanism disengages the ratcheting mechanism to allow the wrench shaft to be pivoted in the second direction with respect to the wrench head.

The method also includes rotating the wrench in a first direction with respect to the threaded shaft such that the wrench head rotates the rotary fastener in the first direction with respect to the threaded shaft. The method further includes rotating the wrench shaft in the first direction with respect to the wrench head such that the ratchet mechanism ratchets at least one step. The method also includes rotating the wrench in the first direction with respect to the threaded shaft such that the wrench head rotates the rotary fastener further in the first direction with respect to the threaded shaft. The rotary fastener is laterally removable from the wrench head by way of the slot regardless of the position of the wrench head with respect to the wrench shaft within a range of motion of the wrench head.

In some embodiments, a wrench includes a wrench shaft, a wrench head, a pivot, a ratcheting mechanism, and a reset mechanism. The wrench shaft has a first end and a second end opposite the first end. The wrench head is pivotally mounted on the first end of the wrench shaft and includes a pair of protrusions. Each protrusion has an engaging surface with a slot formed between the engaging surfaces. The pivot couples the wrench head to the wrench shaft and is located behind the protrusions. The ratcheting mechanism permits the wrench head to pivot in a first direction around the pivot and prevents the wrench head from pivoting in a second direction opposite the first direction. The reset mechanism uncouples the ratcheting mechanism to permit the wrench head to pivot in the second direction.

DETAILED DESCRIPTION OF THE INVENTION

Figure 1:
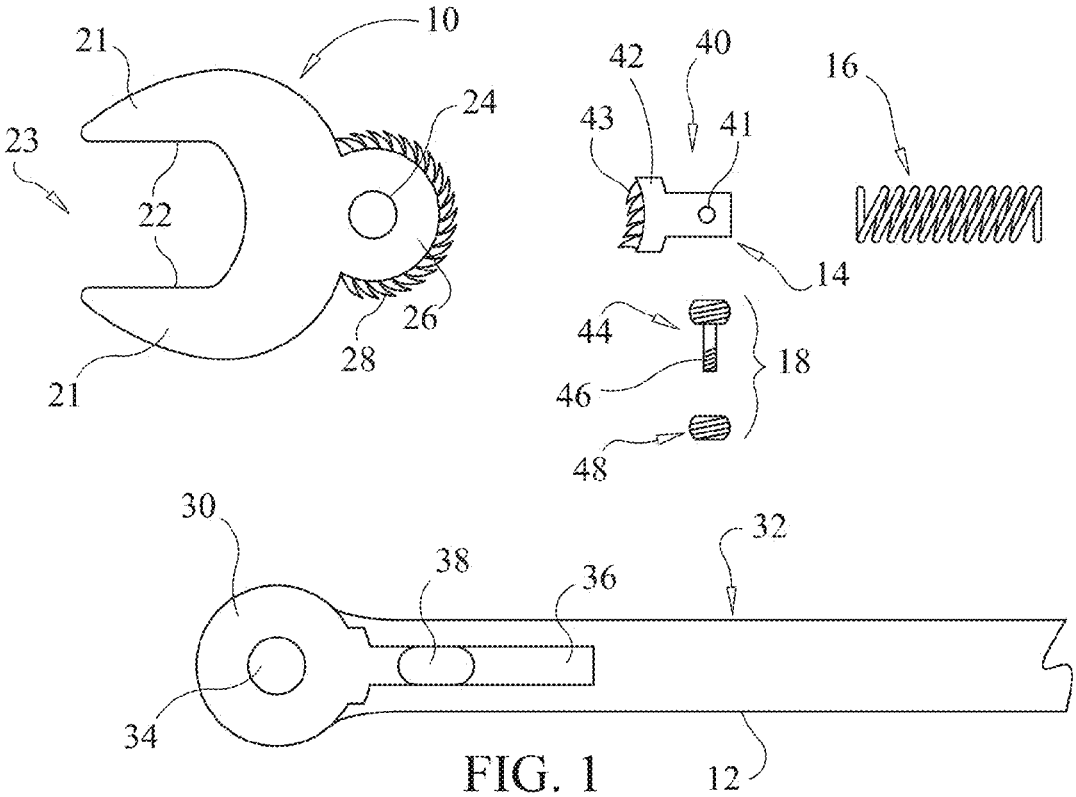
FIG. 1 shows an exploded view of a first end of a wrench in an embodiment of the present invention.

A wrench includes a pivoting open end wrench head and a ratchet mechanism to provide one-way ratcheting of the pivoting open end to rotate a rotary fastener with respect to a threaded shaft, when the rotary fastener is held in the slot formed between the projections of the wrench head. A reset mechanism permits the user to reset the ratchet mechanism. The wrench head includes a pair of projections with engaging surfaces and a slot formed between the engaging surfaces. The engaging surfaces contact opposing sides of the rotary fastener such that rotation of the tool head around the threaded shaft rotates the rotary fastener with respect to the threaded shaft.

The wrench head is preferably a non-adjustable single integral element with the wrench head being the only feature that extends beyond the circular extensions of the wrench shaft at the first end of the wrench shaft. In some embodiments, the engaging surfaces on the projections are substantially planar and substantially parallel to each other. In other embodiments, the engaging surfaces may be at a slight angle, and one or both of the engaging surfaces may include one or more curved portions or indentations. These curved portions or indentations are preferably shaped and located on the engaging surfaces to increase the gripping ability of the wrench head or to prevent slipping of the rotary fastener with respect to the gripping surfaces when the user tries to rotate the rotary fastener with the wrench.

In an alternate embodiment, however, the wrench head may be an adjustable monkey wrench-type head within the spirit of the present invention, where one projection is adjustable with respect to the other projection to change the size of the gap formed between the projections.

The wrench shaft preferably terminates at the first end with the circular extensions of the wrench shaft such that no part of the wrench that rotates with respect to the wrench head blocks the opening between the projections of the wrench head no matter what position the wrench head is in within the angular range of motion of the wrench head.

The wrench head preferably includes a plurality of ratchet teeth mounted radially around a pivot point on the wrench head. The wrench preferably includes a pawl with a plurality of pawl teeth coupled to the wrench shaft and biased toward the ratchet teeth by a biasing element. The wrench more preferably includes only a single pawl mounted in the wrench shaft. The reset mechanism is preferably mounted in a reset hole on the wrench shaft and coupled to the pawl such that a thumb of the user actuates the reset mechanism. Actuation of the reset mechanism preferably retracts the pawl such that the pawl teeth disengage the ratchet teeth, thereby permitting the user to freely rotate the wrench head back toward a reset position. The reset mechanism is preferably accessible from either side of the wrench shaft. When the reset mechanism is actuated, the user is preferably able to reset the wrench head with a flick of the wrist.

The spacing of the ratchet teeth and pawl teeth determines the minimum angle of rotation required to reach the next step of the ratchet. Spacing the teeth closer together reduces the minimum angle of rotation for ratcheting, thus allowing the wrench to work in more confined spaces, but this also decreases tooth size and tooth strength and increases production costs such that there is a lower practical limit for tooth spacing. Locating the ratchet teeth farther from the pivot point allows the ratchet teeth to be larger for a given tooth spacing but also increases the size and weight of the circular extension from which the teeth protrude.

The ratchet teeth and pawl teeth may have any complementary ratchet tooth shapes such that, when engaged and within the range of motion of the wrench head, the teeth permit rotation of the wrench head in one direction but engage to prevent rotation of the wrench head in the opposite direction within the step size of the teeth.

The ratchet teeth and the pawl teeth are preferably sized and spaced such that each step of the ratcheting mechanism requires less than a 30° rotation of the wrench shaft with respect to the pivot point. The ratchet teeth and the pawl teeth are more preferably sized and spaced such that each step of the ratcheting mechanism requires less than a 25°rotation of the wrench shaft with respect to the pivot point. The ratchet teeth and the pawl teeth are more preferably sized and spaced such that each step of the ratcheting mechanism requires less than a 20° rotation of the wrench shaft with respect to the pivot point. The ratchet teeth and the pawl teeth are more preferably sized and spaced such that each step of the ratcheting mechanism requires less than a 15° rotation of the wrench shaft with respect to the pivot point. In some embodiments, the ratchet teeth and the pawl teeth are sized and spaced such that each step of the ratcheting mechanism requires about a 10° rotation of the wrench shaft with respect to the pivot point.

The pawl head is preferably wider than the pawl body to allow for more pawl teeth on the pawl. Increasing the number of teeth that are engaged increases the load sharing and decreases the load on each tooth. The pawl is preferably sized and shaped such that at least three pawl teeth engage the ratchet teeth at any given time during engagement. The pawl is more preferably sized such that at least five pawl teeth engage the ratchet teeth at any given time during engagement.

The difference between the angle over which the ratchet teeth are formed around the pivot point and the angle over which the pawl teeth are formed determines the maximum range of rotation of the wrench head and the maximum amount of rotation of the rotary fastener that is possible without resetting the wrench head. The maximum range of rotation is preferably at least 30°. The maximum range of rotation is more preferably at least 45°. In some embodiments, the maximum range of rotation is at least 60°. In some embodiments, the maximum range of rotation is at least 75°. In some embodiments, the maximum range of rotation is at least 90°. In some embodiments, the maximum range of rotation is at least 105°. In some embodiments, the maximum range of rotation is at least 120°. In some embodiments, the maximum range of rotation is at least 135°. In some embodiments, the maximum range of rotation is at least 150°. In some embodiments, the maximum range of rotation is at least 165°. In some embodiments, the maximum range of rotation is about 180°.

In a method of rotating a rotary fastener with respect to a threaded shaft, an open end of a wrench is placed around the rotary fastener such that the rotary fastener is located in the slot of the wrench head between the projections. In some embodiments, the rotary fastener is laterally placed in the wrench head. The wrench shaft is then moved in a first direction such that the wrench head rotates the rotary fastener in a first direction with respect to the threaded shaft with the ratchet teeth on the wrench head engaging the pawl teeth of a pawl coupled to the wrench shaft. The wrench shaft is then moved in a second direction opposite the first direction such that the wrench shaft rotates around a pivot with respect to the wrench head and the pawl teeth slide at least one step past the ratchet teeth. The wrench shaft is then moved again in the first direction such that the wrench head rotates the rotary fastener farther in the first direction with respect to the threaded shaft with the ratchet teeth on the wrench head engaging the pawl teeth of the pawl. These steps may be repeated until the rotary fastener is sufficiently loosened, sufficiently tightened, or otherwise desirably positioned with respect to the threaded shaft, or until the wrench head is at its rotational limit with respect to the wrench shaft. If the wrench head has reached its rotational limit and further rotation of the rotary fastener is required or desired, the wrench head is taken off the rotary fastener, the reset mechanism is actuated, and the wrench head is reset away from the rotational limit. The process is then repeated until the rotary fastener is sufficiently loosened, sufficiently tightened, or otherwise desirably positioned with respect to the threaded shaft.

In some embodiments, the rotary fastener is located such that the maximum rotation available to the wrench is less than 30°. In some embodiments, the rotary fastener is located such that the maximum rotation available to the wrench is less than 25°. In some embodiments, the rotary fastener is located such that the maximum rotation available to the wrench is less than 20°. In some embodiments, the rotary fastener is located such that the maximum rotation available to the wrench is less than 15°.

Referring to FIG. 1, the wrench includes a wrench head 10, a wrench shaft 12, a pawl 14, a biasing element 16, and a reset mechanism 18. The wrench head 10 includes a pair of projections 21 with engaging surfaces 22 forming a slot 23 on one end of the wrench head 10 to receive a rotary fastener. The wrench head 10 also includes a pivot hole 24 in a circular extension 26 located behind the slot 23 and a plurality of ratchet teeth 28 formed around the pivot hole 24 on the other end of the wrench head 10. Although the pivot hole 24 may be cylindrical for ease of manufacture, since the wrench head 10 does not rotate 360°, the pivot hole 24 is not necessarily cylindrical.

The wrench shaft 12 includes a pair of circular extensions 30 extending from a handle 32. A pair of pivot holes 34 in the extensions 30 aligns with the pivot hole 24 of the wrench head 10 to form the pivot in the assembled wrench. The wrench shaft 12 also includes a machined slot 36 to receive the pawl 14 and the biasing element 16 and a reset hole 38 for the reset mechanism 18. In some embodiments, the biasing element 16 is a coil spring.

The pawl 14 includes a pawl body 40 with a pawl hole 41 to couple the pawl 14 to the reset mechanism 18 and a pawl head 42 with a plurality of pawl teeth 43 that engage the ratchet teeth 28 in the assembled wrench. The pawl body 40 is slidably received in the machined slot 36 such that the machined slot 36 supports the pawl 14 when forces from the wrench head 10 are transferred to the pawl 14. The pawl head 42 is preferably wider than the pawl body 40 to allow more pawl teeth 43. The biasing element 16 is preferably a coil spring of moderate strength that biases the pawl teeth 43 into engagement with the ratchet teeth 28 but is easily retractable when the user engages the reset mechanism with a thumb while grasping the handle 32 with the other four fingers.

The reset mechanism 18 includes a threaded button 44 with a shaft 46 that is threaded through the pawl hole 41 and to an end cap 48 on the other end. The reset mechanism 18 sits in the reset hole 38 and is preferably actuatable from either side of the wrench shaft 12. The reset mechanism 18 is preferably actuated by sliding the button 44 away from the first end of the wrench shaft 12, thereby moving the pawl against the bias of the biasing element 16 and farther into the machined slot 36 and out of engagement with the ratchet teeth 28.

Figure 2:
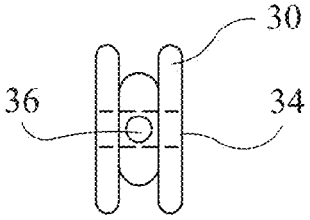
FIG. 2 shows an end view of the first end of the shaft of the wrench of FIG. 1.

FIG. 2 shows the gap between the pair of circular extensions 30 to permit placement of the biasing element 16 and pawl 14 into the machined slot 36 and to receive the circular extension 26 of the wrench head 10. Alternatively, the wrench shaft 12 may have only a single circular extension 30 to couple the wrench shaft 12 rotatably to the wrench head 10. Although the wrench head 10 preferably extends straight from the circular extension 26 such that the projections 21 are in the same plane as the wrench handle 32 and perpendicular to the axis of the pivot, the projections 21 may be at an angle with respect to the handle 32 in some embodiments. In some embodiments, the projections may be offset up to about 5° with respect to the handle. In some embodiments, the projections may be offset up to about 10° with respect to the handle. In some embodiments, the projections may be offset up to about 15° with respect to the handle. The offset angle may be achieved by angling the circular extensions 30 of the wrench shaft 12 with respect to the wrench handle 32, angling the projections 21 with respect to the circular extension 26 of the wrench head 10, or a combination of these.

Figure 3:
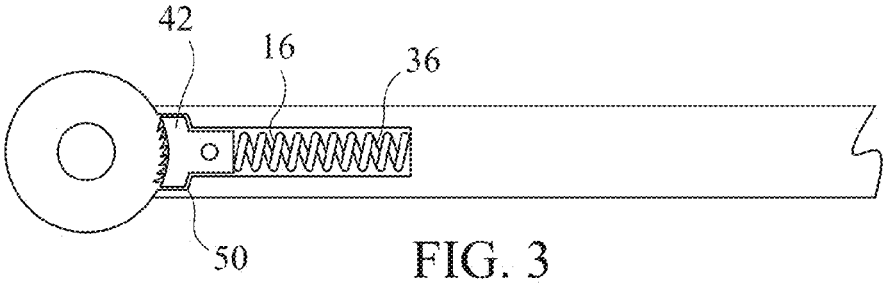
FIG. 3 shows a partial cross-sectional view of the first end of the wrench of FIG. 1 without the wrench head.

FIG. 3 shows the biasing element 16 and pawl 14 mounted in the machined slot 36 without the tool head. The pawl head 42 sits in a recess 50 at the end of the machined slot 36. The recess 50 provides sufficient depth for the pawl 14 to be retracted by the reset mechanism to disengage the pawl teeth from the ratchet teeth, thereby allowing the wrench head to be reset. The shoulders at the back of the recess determine the maximum distance that the pawl is capable of being retracted into the machined slot 36.

Figure 4:
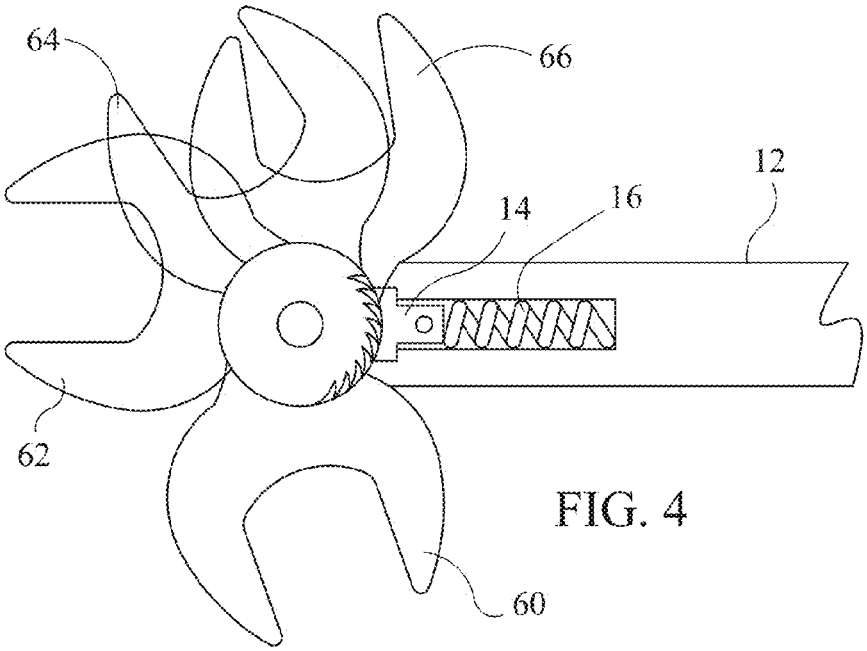
FIG. 4 shows a schematic side view of the first end of the wrench of FIG. 1 with the wrench head in various rotational positions within the range of motion of the wrench head.

FIG. 4 shows the wrench head 10 in four different rotational positions 60, 62, 64, 66 within a 180° range of motion with respect to the wrench shaft 12. In FIG. 4, the pivot axis is substantially perpendicular to the plane of the projections of the tool head.

Figure 5:
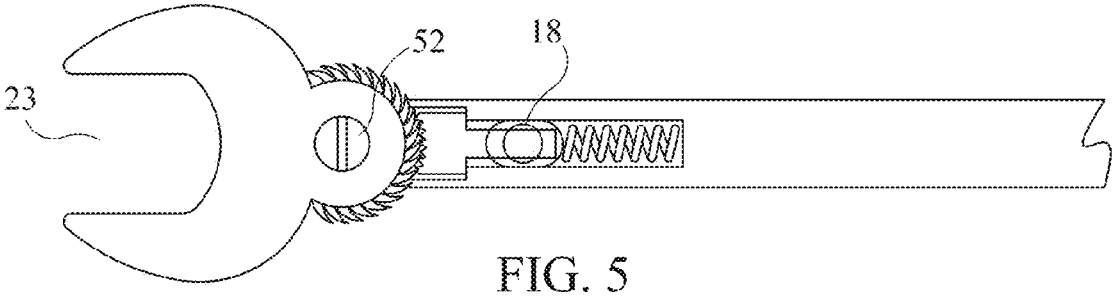
FIG. 5 shows a schematic side view of the first end of the wrench of FIG. 1.
Figure 6:
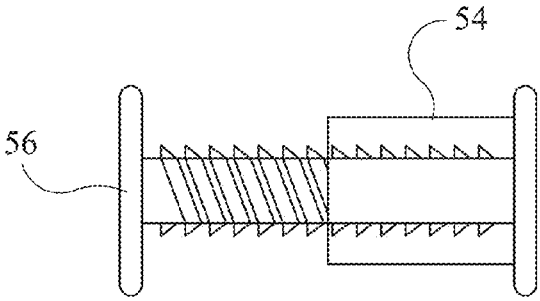
FIG. 6 shows a threaded stud and shoulder nut for the wrench of FIG. 1.

FIG. 5 shows the assembled first end of the wrench with the slot 23 extending straight out from the wrench shaft 12. The wrench head 10 is pivotally held on the end of the wrench shaft 12 by a pin 52 extending through the pivot holes 24, 34. FIG. 6 shows one type of pin 52 that may be used in the pivot holes 24, 34 to form the pivot. The shoulder nut 54 threads onto the threaded shaft of the threaded stud 56 to hold the pin 52 in the pivot holes 24, 34 while allowing the wrench head 10 to rotate around the pivot point.

The second end of the wrench shaft may have any kind of functionality, including, but not limited to, no functionality, an open wrench head, a closed wrench head, a socket wrench head, a pivotable ratcheting open wrench head, a ratcheting closed wrench head, and a ratcheting socket wrench head.

Although FIGS. 1-6 show preferred proportions of the various components of a wrench, the size of the slot, the size and thickness of the wrench head, the diameters and thicknesses of the circular extensions, the size, thickness, shape, and spacing of the pawl teeth and ratchet teeth, the size of the pawl body and pawl head, and the materials used for each of these components are preferably selected based on the intended uses for a particular wrench design and may be varied within a wide range depending on the desired strength of the wrench and geometry of the space in which the wrench is intended to be used.

In some embodiments, the wrench is designed to reach far into a narrow opening to reach a rotary fastener. In some such embodiments, the wrench shaft is preferably oriented 90° with respect to the design of FIGS. 1-6 along its length to allow a slightly greater range of rotary motion in the narrow opening. In some such embodiments, the reset hole, the pawl hole, and the reset mechanism are preferably located farther down the shaft away from the wrench head to provide easier access to the reset mechanism when the wrench head is engaged with the rotary fastener. This may be accomplished by extending the pawl body farther down the machined slot to locate the pawl hole farther from the wrench head by extending the pawl body through the center of the biasing element, by increasing the length of the machined slot, by decreasing the length of the biasing element, or by any combination of these modifications. Alternatively, this may be accomplished by including an extension on the end cap that extends away from the wrench head.

In some embodiments, the wrench parts are made of one or more high strength metals, which may include, but are not limited to, tool steels, including, but not limited to, a chromium-vanadium alloy tool steel. In some embodiments, the wrench parts are made of high strength aluminum. In some embodiments, the high strength aluminum wrenches are non-sparking such that they may be used in environments with flammable volatile gases.

In a preferred embodiment, a plurality of wrenches with pivotable ratcheting open end wrench heads is provided as a wrench set. In some embodiments, the wrench set includes 12 to 14 wrenches. The wrench sets may contain wrenches of different sizes, including, but not limited to metric sizes or standard ("SAE"—Society of Automotive Engineers) sizes, or wrenches of different lengths, including, but not limited to, short, standard, and long. Conventional metric sizes include, but are not limited to, 4 mm, 5 mm, 6 mm, 7 mm, 8 mm, 9 mm, 10 mm, 11 mm, 12 mm, 13 mm, 14 mm, 15 mm, 16 mm, 17 mm, 18 mm, 19 mm, 20 mm, 21 mm, 22 mm, 23 mm, 24 mm, 25 mm, 26 mm, 27 mm, 28 mm, 29 mm, 30 mm, 31 mm, and 32 mm. Conventional standard sizes include, but are not limited to, 5/32", 3/16", 7/32", 1/4", 9/32", 5/16", 11/32", 3/8", 13/32", 7/16", 15/32", 1/2", 17/32", 9/16", 19/32", 5/8", 21/32", 11/16", 23/32", 3/4", 25/32", 13/16", 27/32", 7/8", 29/32", 15/16", 31/32", 1", 1-1/32", 1-1/16", 1-3/32", 1-1/8", 1-5/32", 1-3/16", 1-7/32", 1-1/4", 1-9/32", 1-5/16", 1-11/32", 1-3/8", 1-13/32", 1-7/16", 1-15/32", and 1-1/2".

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A wrench comprising:

a wrench shaft having a first end and a second end opposite the first end;

a wrench head pivotally mounted on the first end of the wrench shaft, the wrench head comprising:

a first end comprising a pair of protrusions, each protrusion having an engaging surface, a wrench head slot being formed between the engaging surfaces; and a second end comprising a plurality of ratchet teeth arranged radially around a pivot hole;

a pawl comprising a plurality of pawl teeth and mounted in a wrench shaft slot in the wrench shaft;

a biasing element biasing the pawl teeth toward engagement with the ratchet teeth; and a reset coupled to the pawl to disengage the pawl from engagement with the ratchet teeth;

wherein the ratchet teeth and pawl, when engaged, permit pivoting of the wrench shaft in a first direction with respect to the wrench head but limit pivoting of the wrench shaft in a second direction opposite the first direction.

2. The wrench of claim 1, wherein the wrench shaft comprises at least one circular protrusion having a pivot hole at the first end of the wrench.

3. The wrench of claim 2, wherein a pivot pin mounted in the pivot holes of the wrench shaft and the wrench head pivotally connects the wrench shaft to the wrench head.

4. The wrench of claim 1, wherein the biasing element is a coil spring mounted in the wrench shaft slot.

5. The wrench of claim 1, wherein the reset comprises a button mounted in a reset hole in the wrench shaft and coupled to the pawl.

6. The wrench of claim 1, wherein the reset mechanism is actuatable on either side of the wrench shaft to disengage the pawl teeth from the ratchet teeth.

7. The wrench of claim 1, wherein the ratchet teeth are spaced less than 20° apart.

8. The wrench of claim 1, wherein the ratchet teeth are spaced less than 15° apart.

9. The wrench of claim 1, wherein the ratchet teeth are spaced about 10° apart.

10. The wrench of claim 1, wherein the wrench head is pivotable by at least 60° with respect to the wrench shaft.

11. The wrench of claim 1, wherein the wrench head is pivotable by less than about 180° with respect to the wrench shaft.

12. The wrench of claim 1, wherein the second end of the wrench shaft comprises a functionality selected from the group consisting of: an open wrench head, a closed wrench head, a socket wrench head, a pivotable ratcheting open wrench head, a ratcheting closed wrench head, and a ratcheting socket wrench head.

13. The wrench of claim 1, wherein the wrench is formed of a high strength aluminum.

14. The wrench of claim 1, wherein the wrench is formed of a tool steel.

15. A method of rotating a rotary fastener around a threaded shaft comprising the steps of:

a) placing a pair of protrusions of a wrench around the rotary fastener, the wrench comprising:

a wrench shaft having a first end and a second end opposite the first end;

a wrench head pivotally mounted on the first end of the wrench shaft, the wrench head comprising the protrusions, each protrusion having an engaging surface, a slot being formed between the engaging surfaces;

a ratchet permitting pivoting of the wrench shaft in a first direction with respect to the wrench head but limiting pivoting of the wrench shaft in a second direction opposite the first direction; and a reset disengaging the ratchet to allow the wrench shaft to be pivoted in the second direction with respect to the wrench head;

b) rotating the wrench with respect to the threaded shaft such that the wrench head rotates the rotary fastener with respect to the threaded shaft;

c) rotating the wrench shaft in the first direction with respect to the wrench head such that the ratchet advances at least one step; and d) rotating the wrench with respect to the threaded shaft such that the wrench head rotates the rotary fastener further with respect to the threaded shaft;

wherein the wrench head is laterally removable from the rotary fastener by way of the slot regardless of the position of the wrench head with respect to the wrench shaft within a range of motion of the wrench head.

16. The method of claim 15, wherein in step c) the wrench shaft is rotated less than 30° in the first direction with respect to the wrench head.

17. The method of claim 15, wherein in step c) the wrench shaft is rotated less than 20° in the first direction with respect to the wrench head.

18. The method of claim 15, wherein in step c) the wrench shaft is rotated less than 15° in the first direction with respect to the wrench head.

19. The method of claim 15 further comprising the steps of:

e) taking the wrench head off the rotary fastener;

f) actuating the reset and pivoting the wrench shaft in the second direction with respect to the wrench head;

g) re-placing the pair of protrusions around the rotary fastener; and h) rotating the wrench with respect to the threaded shaft such that the wrench head rotates the rotary fastener further with respect to the threaded shaft.

* * * * *